United States Patent [19]

Allan

[11] Patent Number: 4,501,654

[45] Date of Patent: Feb. 26, 1985

[54] DELAYED COKING PROCESS WITH SPLIT FRESH FEED AND TOP FEEDING

[75] Inventor: David E. Allan, Baton Rouge, La.

[73] Assignee: Exxon Research & Engineering Co., Florham Park, N.J.

[21] Appl. No.: 594,851

[22] Filed: Mar. 29, 1984

Related U.S. Application Data

[63] Continuation-in-part of Ser. No. 552,625, Nov. 17, 1983.

[51] Int. Cl.[3] ..... C10G 9/14

[52] U.S. Cl. ..... 208/92; 208/100; 208/131

[58] Field of Search ..... 208/100, 131, 92

[56] References Cited

U.S. PATENT DOCUMENTS

| | | | |
|---|---|---|---|
| 1,865,027 | 6/1932 | Loomis | 208/131 |
| 1,986,593 | 1/1935 | Morrell | 208/131 |
| 2,005,118 | 6/1935 | Voorhees | 208/131 |
| 2,061,833 | 11/1936 | Egloff et al. | 208/131 |
| 2,062,254 | 11/1936 | Atwell | 208/131 |
| 2,159,502 | 5/1939 | Corrough | 208/131 |
| 3,617,480 | 11/1971 | Keel | 208/50 |
| 3,687,840 | 8/1972 | Sze et al. | 208/131 |
| 3,769,200 | 10/1973 | Folkins | 208/131 |
| 4,066,532 | 1/1978 | Garcia | 208/131 |

*Primary Examiner*—Delbert E. Gantz
*Assistant Examiner*—O. Chaudhuri
*Attorney, Agent, or Firm*—Marthe L. Gibbons

[57] ABSTRACT

A delayed coking process is provided in which the fresh hydrocarbonaceous oil feed is divided into at least two streams. One stream is introduced directly into the preheating zone of the coking zone and one stream is introduced into the coker product fractionator. The fractionator bottoms fraction is recycled to the preheating zone as a separate stream from the fresh feed stream. The separate preheated fresh feed stream is introduced into the top of the coking zone and the preheated recycled fractionator bottoms fraction is introduced into the bottom of the coking zone. The given fresh feed splitting configuration permits decreasing the recycle rate of the heavy coker product and increasing liquid yield while the top and bottom feeding to the coking zone permit subjecting the given streams to different severity of coking.

10 Claims, 1 Drawing Figure

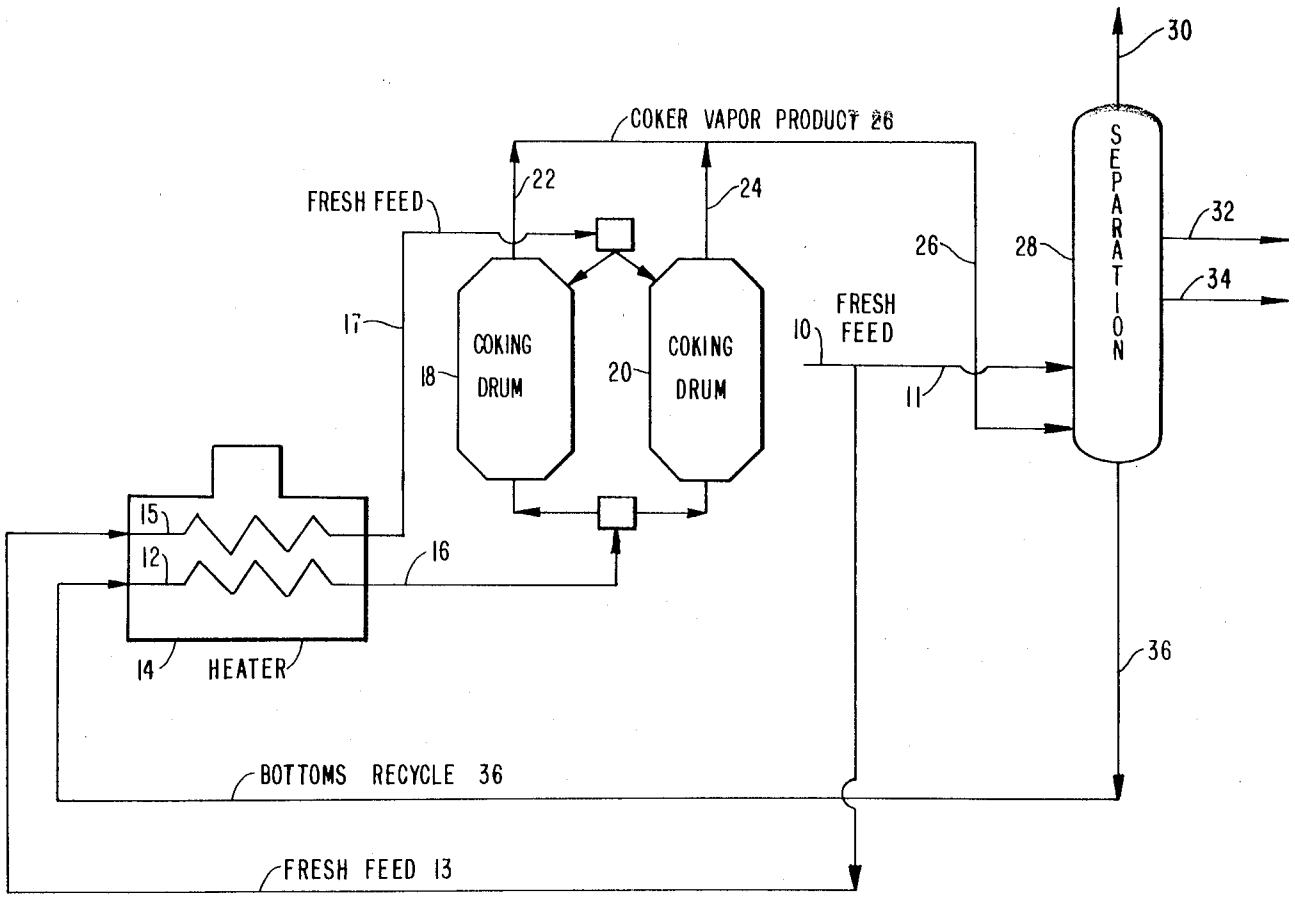
SEPARATION
30
32
34
36
28
26
11
FRESH FEED
10
COKER VAPOR PRODUCT 26
24
22
COKING DRUM
20
COKING DRUM
18
FRESH FEED
17
16
HEATER
15
12
14
BOTTOMS RECYCLE 36
FRESH FEED 13

DELAYED COKING PROCESS WITH SPLIT FRESH FEED AND TOP FEEDING

This application is a continuation-in-part of U.S. Ser. No. 552,625, filed Nov. 17, 1983, the teachings of which are hereby incorporated by reference.

BACKGROUND OF THE INVENTION

1. Field of the Invention

This invention relates to an improvement in a delayed coking process.

2. Description of the Prior Art

Delayed coking is a well-known process in which a hydrocarbonaceous oil is heated to a coking temperature and the preheated oil is introduced into a coking drum to produce a vapor phase product, including normally liquid hydrocarbons and coke. The drum is decoked by hydraulic means or by mechanical means. In most configurations of the delayed coking process, the fresh hydrocarbonaceous coker feed is introduced into the coker product fractionator, usually for heat exchange purposes, where it combines with the heavy coker products that are recycled to the coker heater. See *Hydrocarbon Processing*, September, 1980, page 153.

It is known that decreasing the recycle ratio of the fractionator bottoms fraction that is recycled to the coking preheater will increase the hydrocarbon liquid yield and decrease the coke yield of the delayed coker. See, for example, "Delayed Coking. Latest Trends" in *Hydrocarbon Processing*, May 1982, pages 99 to 104, where the effect of recycle ratio to coke yield is shown. As recycle decreases, the cut point of the recycle increases.

All boiling points referred to herein are atmospheric pressure boiling points unless otherwise specified.

The effect of recycle ratio of heavy coker hydrocarbon product and cut point of the fractionator bottoms recycle on coker product yields is shown in Table I, which summarizes the results of delayed coking run A and delayed coking run B, in which the same feed, namely, a vacuum residuum was utilized.

TABLE I

Effect of Cut Point of Bottoms Recycle on Yields in Delayed Coking

| Run | A | B |
|---|---|---|
| Feed - Vacuum Residuum | | |
| Gravity, °API at 60° F. | 8.6 | 7.4 |
| Conradson Carbon wt. % | 17.5 | 18.3 |
| Sulfur, wt. % | 3.2 | 3.1 |
| Ash, wt. % | 0.035 | 0.019 |
| Operating Conditions | | |
| Coil outlet temperature °F. | 930 | |
| Coke drum pressure, psig | 33 | |
| (1)Recycle, wt. % on fresh feed | 14.8 | 9.8 |
| Cut point between Heavy Gas Oil and Recycle, °F. | 848 | 895 |
| Yields on Fresh Feed | | |
| $C_1$-$C_2$ gas, wt. % | 4.92 | 4.56 |
| $C_3$-$C_4$ gas, vol. % | 8.31 | 8.20 |
| $C_5$-cut point liquids, vol. % | 70.91 | 72.18 |
| Coke, wt. % | 31.7 | 31.0 |
| Coke (corrected, wt. %(2)) | 31.7 | 29.6 |

(1)Recycled heavy coker product.

(2)Coke yield on run B corrected to run A Conradson carbon (i.e., 17.5 wt. %) using the average carbon producing factor, that is, coke yield to feed Conradson Carbon Residue.

In run A, the cut point of the fractionator bottoms recycle was 848° F. In run B, the cut point was 895° F. As can be seen from table I, run B produced 29.6 weight percent coke, whereas run A produced 31.7 weight percent coke. Thus, when it is desired to minimize coke production is delayed coking and increase the hydrocarbon liquid yield, it is desirable to increase the cut point of the fractionator bottoms recycle stream.

U.S. Pat. No. 2,159,502 discloses a coking process in which a portion of the coking feed is sent to a product fractionator and a portion is sent directly to a coke chamber.

U.S. Pat. No. 4,066,532 discloses a coker feedstock introduced directly into a furnace in an admixture with product fractionator bottoms.

It is known to introduce the hydrocarbonaceous feed into the top of a coking drum. See, for example, U.S. Pat. Nos. 1,986,593; 2,005,118 and 2,061,833.

It has now been found that the cut point of the fractionator bottoms fraction that is withdrawn from the fractionator and recycled to the coker preheating zone can be increased and the coking severity can be decreased when the fresh oil coker feed is split into at least two streams and that these streams are introduced at specified locations in the process, including introducing at least a portion of the preheated fresh feed into the top of the coking zone.

SUMMARY OF THE INVENTION

In accordance with the invention, there is provided, in a delayed coking process which comprises the steps of: (a) preheating a hydrocarbonaceous oil chargestock to a coking temperature in a preheating zone; (b) introducing the resulting preheated oil chargestock into a coking zone at delayed coking conditions to form coke and a vapor phase product, including heavy and light hydrocarbon products; (c) introducing said vapor phase product and a fresh hydrocarbonaceous oil into a separation zone; (d) withdrawing a heavy bottoms fraction, including at least a portion of said heavy hydrocarbon products, from said separation zone, and (e) recycling at least a portion of said withdrawn bottoms fraction to said preheating zone of step (a), the improvement which comprises: (f) introducing a first portion of a fresh hydrocarbonaceous oil directly as a separate stream from said recycled bottoms fraction of step (e) into said preheating zone of step (a) to preheat said first portion of fresh oil; (g) introducing a second portion of said fresh hydrocarbonaceous oil into said separation zone of step (c), and (h) introducing said preheated first portion of fresh feed into an upper portion of said coking zone.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a fresh hydrocarbonaceous oil feed carried in line 10 is split into a first portion and a second portion. The first portion of the fresh oil feed is removed from line 10 by line 13 and introduced directly as a separate stream into coil 15 of coking heater 14. The second portion of the fresh oil feed is passed by line 11 into separation zone 28 and processed as will be described later. The fresh oil feed of line 10 is desirably split such that at least about 20 weight percent, generally from about 20 to 80 weight percent, preferably from about 40 to about 80 weight percent, based on total fresh oil feed to the entire process, is introduced directly into coil 15 of coking heater 14. Suitable fresh hydrocarbonaceous oil feeds include heavy hydrocarbonaceous oils; whole and reduced petroleum crude oils, including heavy crude oils; petroleum atmospheric distillation bottoms; petroleum vacuum distillation bottoms; pitch; asphalt; bitumen; other heavy hydrocarbon residues; tar sand oils; shale oil; liquid products derived from coal liquefaction processes, including coal liquefaction bottoms and mixtures thereof. Typically, such feeds have a Conradson carbon content of at least about 5 weight percent, generally from about 5 to about 50 weight percent, preferably above about 7 weight percent (as to Conradson carbon residue, see ASTM test D-189-65). These oils usually have a high metals content (vanadium, iron and nickel). The metals content may range up to 2000 wppm metal or more. The oil is preheated in coil 15 of heater 14 to a coking temperature ranging from about 775° to about 1000° F., preferably from about 875° to about 950° F. Coil 15 outlet pressure will range suitably from about 10 to about 200 psig, preferably from about 50 to about 100 psig. In preheater 14, the oil is partially vaporized and mildly cracked. The preheated oil (vapor-liquid mixture) is removed from coil 15 of heater 14 and passed by line 17 into the upper portion (top) of one of two coking drums, 18 and 20 (i.e., delayed coking zone), connected to coking heater 14. When one drum is in use, the other drum is being decoked. The term "upper portion" is used herein to designate that portion of the drum above the final coke level. Typically, the upper portion is approximately the top 25% of the coking drum. The coking drum operates at a lower temperature than the heater coil outlet temperature since the coking reaction is endothermic. Suitable pressures in the coking drums range from about 20 to about 60 psig. The residence time in the coking drum is generally from about a half hour to about 36 hours, that is, a time sufficient to fill the drum with coke. The vapor phase overhead product of the coking drum, which includes light and heavy normally liquid hydrocarbons, is removed from the respective coking drums by lines 22 and 24 and passed by line 26 to a separation zone, such as fractionator 28, where the coker overhead product is separated into fractions. The second portion of fresh oil feed that was removed from line 10 by line 11 is introduced into fractionator 28 wherein it mixes with the coker vapor phase product and quenches the vapor. A gas is removed from fractionator 28 by line 30. A light fraction is removed by line 32 and an intermediate boiling fraction is removed by line 34 from fractionator 28. The heavier bottoms fraction, which includes fresh oil and a portion of the heavy hydrocarbons that were separated from the coker vapor product, is removed from fractionator 28 by line 36. The initial boiling point of the heavy bottoms fraction withdrawn by line 36, (i.e., fractionator bottoms fraction) will range from about 950° to about 850° F., preferably from about 950° to about 980° F. At least a portion of the heavy bottoms fraction withdrawn by line 36 is recycled to coil 12 located in heater 14. It should be noted that the bottoms fraction that is recycled by line 36 is introduced into heater 14 as a separate stream from the fresh feed carried in line 13 and that recycle stream 36 is preheated separately in coil 12 which is operated within the same range of operating conditions as described for coil 15. The preheated heavy bottoms fraction is removed from coil 12 by line 16 and introduced into the bottom portion of coking drum 18 or coking drum 20. By "bottom portion" is intended herein the bottom fourth portion of the coking drum. The ratio of heavy coker product recycled to heating coil 12 will range, suitably, from about 1 to 15 weight percent, preferably from about 1 to 10 weight percent, based on total fresh feed.

For example, if stream 10 were 30,000 barrels per day, stream 13 were 15,000 barrels per day and stream 36 were 18,000 barrels per day, then the recycle rate would be 10% on total fresh feed.

Splitting of the fresh oil feed into a portion that is introduced directly into the preheating zone of the coker and another portion that is introduced into the coker product fractionator permits decreasing the recycle ratio and, thereby, increasing the cut point of the heavy bottoms fraction which is removed from the fractionator. Introducing one portion of the preheated fresh coking feed into the upper portion of the coking zone permits low severity coking of a portion of the fresh feed while subjecting the recycled bottoms fraction to higher severity coking due to the introduction into the bottom of the coking zone where the recycled fraction is present for a longer residence time.

The effect of introducing the fresh feed into the top of the coking zone instead of introducing it into the bottom of the coking zone is shown in Table II. The same feed, namely, an atmospheric residuum, was used in runs C, D and E. In run C, the feed was introduced into the bottom of a delayed coking zone. In runs D and E, the feed was introduced into the top of the delayed coking zone.

TABLE II

| Run | C | D | E |
|---|---|---|---|
| Feed | ←East Texas Atm. Residuum→ 17.2° API, 8.9 wt. % CCR[3] | | |
| Conditions: | | | |
| Drum Inlet Temp., °F. | 886 | 898 | 871 |
| Coil Outlet Pres., psig | 10 | 8 | 0 |
| Once-Through Yields, wt. % | | | |
| $C_3$- gas | 2.3 | 2.3 | 1.9 |
| $C_4$-400° F. naphtha | 9.8 | 7.4 | 7.5 |
| 400° F. + gas oil | 77.5 | 83.2 | 83.1 |
| Coke | 10.4 | 7.1 | 7.5 |
| | 100.0 | 100.0 | 100.0 |
| Other Properties | | | |
| Coke VCM, wt. %[1] | 13.8 | 10.0 | 11.1 |
| 400° F.+ Con. Carbon, wt. % | 1.72 | 2.47 | 2.30 |
| Ultimate Yields, wt. %[2] | | | |
| $C_3$- gas | 3.4 | 3.7 | 3.3 |
| $C_4$-400° F. naphtha | 14.6 | 12.0 | 13.0 |
| 400-900° F. gas oil | 69.1 | 73.3 | 73.1 |
| Coke | 12.9 | 11.1 | 10.6 |

TABLE II-continued

| Run | C | D | E |
|---|---|---|---|
| | 100.0 | 100.0 | 100.0 |

(1)Volatile combustible matter (2)Coke yield was converted to ultimate coke yield using the average carbon producing factor, that is, coke yield to feed Conradson carbon residue.

(3)CCR means Conradson carbon residue.

As can be seen from Table II, on an ultimate yield basis, feed introduction near the top reduced coke yield by about 15% and increased net $C_4$-900° F. liquid yield by about 2.0 weight percent. Runs D and E (both top feeding runs) also show reduced coke and naphtha yield with most of the balance (4.0–4.2 weight percent) being middle distillate/gas oil fraction.

What is claimed is:

1. In a delayed coking process which comprises the steps of:

(a) preheating a hydrocarbonaceous oil chargestock to a coking temperature in a preheating zone;

(b) introducing the resulting preheated oil chargestock into a coking zone at delayed coking condition to form coke and a vapor phase product, including heavy and light hydrocarbon products;

(c) introducing said vapor phase product and a fresh hydrocarbonaceous oil into a separation zone;

(d) withdrawing a heavy bottoms fraction, including at least a portion of said heavy hydrocarbon products, from said separation zone, and (e) recycling at least a portion of said withdrawn bottoms fraction to said preheating zone of step (a), the improvement which comprises:

(f) introducing a first portion of a fresh hydrocarbonaceous oil directly as a separate stream from said recycled bottoms fraction of step (e) into said preheating zone of step (a) to preheat said first portion of fresh oil;

(g) introducing a second portion of said fresh hydrocarbonaceous oil into said separation zone of step (c);

(h) introducing said preheated first portion of fresh feed into an upper portion of said coking zone, and (i) introducing at least a portion of the preheated recycled bottoms fraction resulting from step (e) into a bottom portion of said coking zone.

2. The process of claim 1 wherein said first portion of fresh oil is introduced directly into said preheating zone of step (a) in an amount ranging from about 20 weight percent to about 80 weight percent, based on total fresh feed.

3. The process of claim 1 wherein said first portion of fresh oil feed is introduced directly into said preheating zone of step (a) in an amount ranging from about 40 to about 80 weight percent, based on total fresh feed.

4. The process of claim 1 wherein said heavy hydrocarbon products of step (d) are recycled at a rate ranging from about 1 to 15 weight percent based on total fresh feed.

5. The process of claim 1 wherein said heavy hydrocarbon products of step (d) are recycled at a rate ranging from about 1 to 10 weight percent based on total fresh feed.

6. The process of claim 1 wherein said separation zone of step (c) is a fractional distillation zone.

7. The process of claim 1 wherein said hydrocarbonaceous oil chargestock is preheated in step (a) to a temperature ranging from about 775° F. to about 1000° F.

8. The process of claim 1 wherein said upper portion of said coking zone comprises the top 25% of said zone.

9. The process of claim 1 wherein said first portion of fresh hydrocarbonaceous oil of step (f) has a Conradson carbon content of at least about 5 weight percent.

10. The process of claim 1 wherein the initial boiling point of said heavy bottoms fraction of step (d) ranges from about 950° to 850° F.

* * * * *